US007912647B2

(12) United States Patent
DiFoggio

(10) Patent No.: US 7,912,647 B2
(45) Date of Patent: Mar. 22, 2011

(54) METHOD AND APPARATUS FOR MEASURING TRUE VERTICAL DEPTH IN A BOREHOLE

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 114 days.

(21) Appl. No.: 12/052,001

(22) Filed: Mar. 20, 2008

(65) Prior Publication Data

US 2009/0235732 A1 Sep. 24, 2009

(51) Int. Cl.
*G01V 3/08* (2006.01)
*G01B 7/26* (2006.01)

(52) U.S. Cl. ..... 702/6; 702/9; 702/158; 702/159; 702/166; 324/328; 324/333; 324/335

(58) Field of Classification Search ..... 702/6, 9, 702/158, 159, 166; 324/328, 333, 335
See application file for complete search history.

(56) References Cited

U.S. PATENT DOCUMENTS

| | | | | |
|---|---|---|---|---|
| 5,019,978 | A | 5/1991 | Howard, Jr. et al. | |
| 5,420,549 | A * | 5/1995 | Prestage | 331/94.1 |
| 6,837,105 | B1 | 1/2005 | DiFoggio et al. | |
| 6,957,580 | B2 | 10/2005 | Ekseth et al. | |
| 6,976,392 | B2 * | 12/2005 | DiFoggio et al. | 73/152.46 |
| 7,253,671 | B2 | 8/2007 | Hall et al. | |
| 2004/0117118 | A1 | 6/2004 | Collins et al. | |
| 2007/0189777 | A1 * | 8/2007 | Arahira | 398/155 |

OTHER PUBLICATIONS

Ch. Salomon, Cold atoms in space and atomic clocks: ACES, Nov. 2001, Académie des sciences/Éditions scientifiques et médicales Elsevier SAS, Comptes Rendus de l'Académie des Sciences—Series IV—Physics, vol. 2, Issue 9, p. 1313-1330.*

S. A. Diddams, Th. Udem, J. C. Bergquist, E. A. Curtis, R. E. Drullinger, L. Hollberg, W. M. Itano, W. D. Lee, C. W. Oates, K. R. Vogel, D. J. Wineland1; An Optical Clock Based on a Single Trapped 199Hg+ Ion; Aug. 3, 2001; Science Express; vol. 293. No. 5531, pp. 825-828; DOI: 10.1126/science.1061171.*

A. Godone, C. Novero, and P. Tavella; Null gravitational redshift experiment with nonidentical atomic clock; May 1995, The American Physical Society, Phys. Rev. D 51; p. 319-323.*

Time Too Good to Be True, [online]; [retrieved on Mar. 19, 2008]; retrieved from the Internet http://www.physicstoday.org/vol-59/iss-3/p10.html.

International Search Report for International Application No. PCT/US2009/034600. Mailed. Sep. 30, 2009.

Written Opinion of the International Searching Authority for International Application No. PCT/US2009/034600. Mailed Sep. 30, 2009.

* cited by examiner

*Primary Examiner* — Sujoy K Kundu
(74) *Attorney, Agent, or Firm* — Cantor Colburn LLP

(57) ABSTRACT

A system for measuring a true vertical depth of a downhole tool is provided. The system includes: a first optical clock located at a first depth and having a first frequency; a second optical clock disposable at a downhole location and having a second frequency at the downhole location; and a processor for receiving the first frequency and the second frequency, and calculating a true vertical depth of the second optical clock based on a difference between the first frequency and the second frequency. A system and computer program product for measuring a true vertical depth of a downhole tool are also provided.

20 Claims, 3 Drawing Sheets

METHOD AND APPARATUS FOR MEASURING TRUE VERTICAL DEPTH IN A BOREHOLE

BACKGROUND

Various formation evaluation (FE) tools are used in hydrocarbon exploration and production to measure properties of geologic formations during or shortly after the excavation of a borehole. The properties are measured by formation evaluation tools and other suitable devices, which are typically integrated into a bottom hole assembly (BHA).

Such tools provide for making downhole measurements versus "measured depth" (which is the distance to the surface along the wellbore path) and/or versus time for one or more physical quantities in or around a borehole. The taking of these measurements may be referred to as "logging", and a record of such measurements may be referred to as a "log". Many types of measurements are made to obtain information about the geologic formations. Some examples of the measurements include gamma ray logs, nuclear magnetic resonance logs, neutron logs, resistivity logs, and sonic or acoustic logs or, for station logs, formation fluid pressures. True vertical depth (TVD) is the vertical distance between a downhole location and the surface. Various downhole physical properties depend on TVD but not on measured depth. For example, over a region of fluid filled permeable rock, the change in fluid pressure, $\Delta P$, equals the product of the fluid density, $\rho$, with the acceleration of gravity, g, and change in true vertical depth, $\Delta TVD$ (i.e., $\Delta P=\rho g\Delta TVD$). Similarly, overburden pressure depends on TVD and, in turn, sound speed through rock depends on overburden and other factors.

Examples of logging processes include measurement-while-drilling (MWD) and logging-while-drilling (LWD) processes, during which measurements of properties of the formations and/or the borehole are taken downhole during or shortly after drilling. The data retrieved during these processes may be transmitted to the surface, and may also be stored with the downhole tool for later retrieval. Other examples include logging measurements after drilling, wireline logging, and drop shot logging.

FE tools often use real-time clocks that, when post-processing the logged data, allow the data to be correlated with associated times and depths. Such clocks allow individual measurements performed during logging to be assigned specific measured depths. One pre-condition for assuring accurate time (and thus measured depth) assignments is that both downhole and uphole clocks run synchronized.

The orientation of the logging tool is typically with respect to a vertical axis and magnetic north. Even small errors in determination of the borehole depth can corrupt logging data. An assumption that the logging instrument is moving smoothly through the borehole is not always valid due to rugose and sticky borehole conditions. Additionally, tool centralizers and decentralizers may keep the logging tool from moving smoothly. Horizontal deviations of the borehole may also lead to errors in measuring the borehole depth. It is, therefore, important to know the "true vertical depth" of the logging instrument as well as knowing the measured depth along the wellbore.

SUMMARY

Disclosed herein is a system for measuring a true vertical depth of a downhole tool. The system includes: a first optical clock located at a first depth and having a first frequency; a second optical clock disposable at a downhole location and having a second frequency at the downhole location; and a processor for receiving the first frequency and the second frequency, and calculating a true vertical depth of the second optical clock based on a difference between the first frequency and the second frequency.

Also disclosed herein is a method of measuring a true vertical depth of a downhole tool. The method includes: positioning a first clock at a first depth; positioning the tool and a second clock at a downhole location; measuring a first frequency of the first clock and a second frequency of the second clock; and calculating a true vertical depth of the second optical clock based on a difference between the first frequency and the second frequency.

Further disclosed herein is a computer program product including machine readable instructions stored on machine readable media. The instructions are for measuring a true vertical depth of a downhole tool, by implementing a method including: positioning a first clock at a first depth; positioning the tool and a second clock at a downhole location; measuring a first frequency of the first clock and a second frequency of the second clock; and calculating a true vertical depth of the second optical clock based on a difference between the first frequency and the second frequency.

BRIEF DESCRIPTION OF THE DRAWINGS

The following descriptions should not be considered limiting in any way. With reference to the accompanying drawings, like elements are numbered alike.

DETAILED DESCRIPTION

There is provided a system and method for measuring true vertical depth that utilizes an optical clock to measure depth. Such measurements may be performed in an existing borehole, or may be performed during logging processes such as measurement-while-drilling (MWD) and logging-while-drilling (LWD) processes. In one embodiment, the system and method is used to measure true vertical depth by computing a change in gravitational potential (i.e., a gravitational red shift) between a surface optical clock and a downhole optical clock. The gravitational red shift of a clock at a point in the borehole can be correlated to the true vertical depth of the clock. As used herein, "downhole" refers to any subsurface location in a formation or other area. "Gravitational red shift" refers to the phenomenon in which a photon traveling upward against gravity loses energy so that its color is shifted towards the red. That is, an upward-going photon's frequency declines in proportion to the change in gravitational potential between the start and end locations of its journey. Similarly, a falling photon gains energy and is blue shifted. If two identical optical clocks start out at the same depth and one clock is moved upward against gravity to a new, higher location and the upper clock emits a photon at its resonant frequency down to the lower clock, then, upon arriving at the lower clock, this photon will be blue shifted so that the lower clock will see the upper clock as running fast. Likewise, a photon sent upward from the lower clock to the upper clock will be red shifted so that, upon arriving at the upper clock, the upper clock will see the lower clock as running slow. Note that, according to either clock's timekeeping, the upper clock is ticking faster than the lower clock.

A detailed description of one or more embodiments of the disclosed system and method are presented herein by way of exemplification and not limitation with reference to the Figures.

Figure 1:
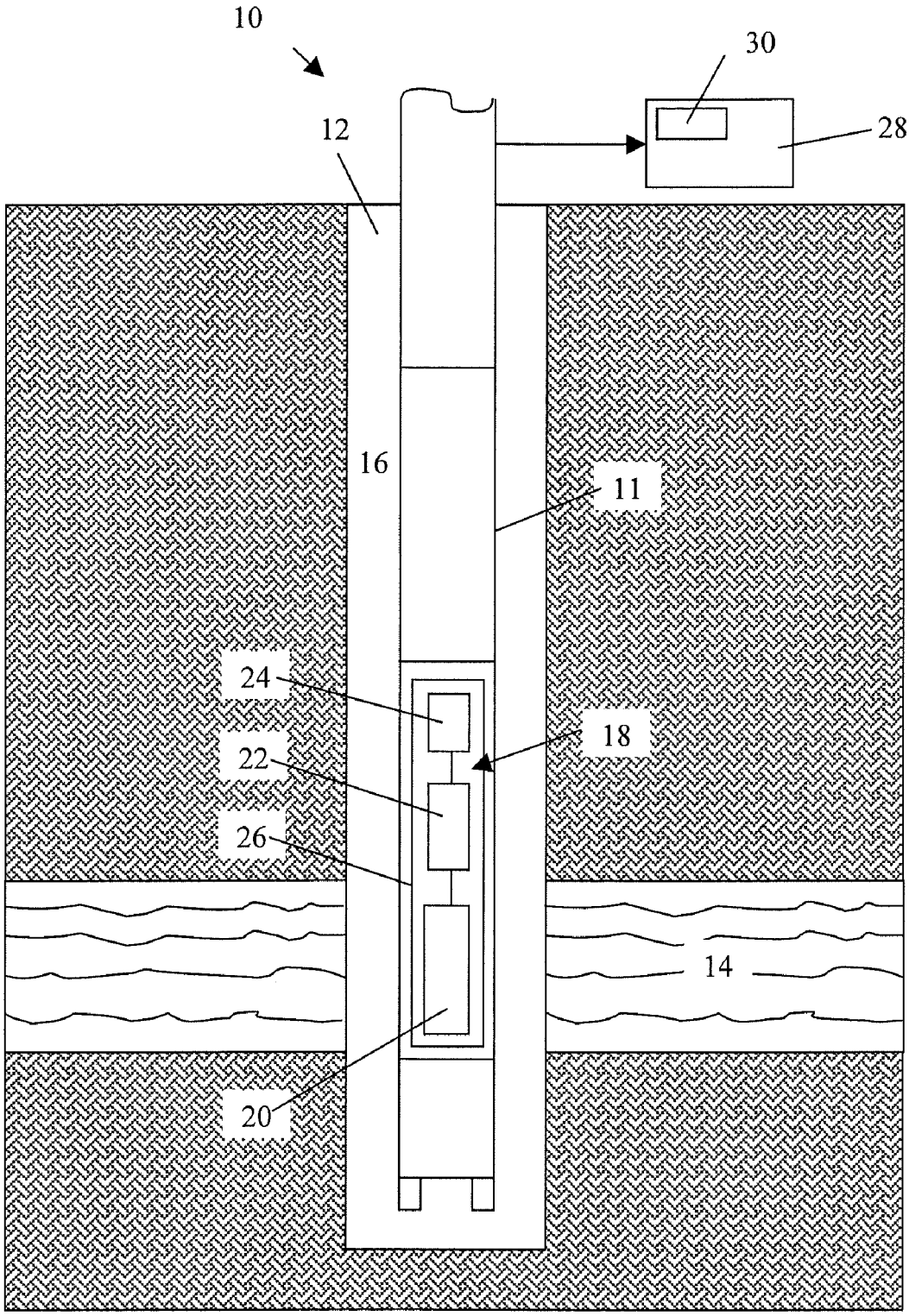
FIG. 1 depicts an exemplary embodiment of a logging system.

Referring to FIG. 1, an exemplary embodiment of a well logging system 10 includes a drillstring 11 that is shown disposed in a borehole 12 that penetrates at least one earth formation 14 for making measurements of properties of the formation 14 and/or the borehole 12 downhole. Drilling fluid, or drilling mud 16 may be pumped through the borehole 12. As described herein, "formations" may refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area).

A downhole tool 18 may be disposed in the well logging system 10 at or near the downhole portion of the drillstring 11, and may include various sensors or receivers 20 to measure various properties of the formation 14 as the tool 18 is lowered down the borehole 12. Such sensors 20 include, for example, nuclear magnetic resonance (NMR) sensors, resistivity sensors, porosity sensors, gamma ray sensors, seismic receivers and others.

In one embodiment, the tool 18 may be inserted in the drillstring 11, and allowed to fall by gravity to a downhole position, or be pumped to the downhole position via the mud 16. In other embodiments, the tool 18 may be lowered by a wireline, inserted during a MWD or LWD process, or inserted downhole by any other suitable processes.

The tool 18 may also include a downhole clock 22 or other time measurement device for indicating a time at which each measurement was taken by the sensor 20. The tool 18 may further include an electronics unit 24. The sensor 20 and the downhole clock 22 may be included in a common housing 26. The electronics unit 24 may also be included in the housing 26, or may be remotely located and operably connected to the sensor 20 and/or the downhole clock 22. With respect to the teachings herein, the housing 26 may represent any structure used to support at least one of the sensor 20, the downhole clock 22, and the electronics unit 24.

In one embodiment, the downhole clock 22 is an optical clock or includes an optical clock. "Optical clock" refers to an atomic clock that is synchronized to an optical-frequency atomic electron transition. An exemplary optical clock is the National Institute of Standards and Technology (NIST) optical clock, such as the NIST clock based on the Mercury 199 ion, which has a frequency accuracy of about $8\times10^{-17}$. The optical clock may be compared to an atomic clock, which is synchronized to a lower microwave-frequency atomic electron transition. Optical clocks oscillate about 100 thousand times faster than do the microwave atomic clocks, so they have far higher resolution and precision.

In one embodiment, the downhole clock 22 includes an optical "frequency comb" to convert optical "ticks", i.e., oscillations, to microwave frequency "ticks" so that they can be counted. The frequency comb may take the form of a self-referenced, mode-locked laser to bridge the gap between radio frequency, which can be counted by present-day electronic circuits, and optical frequencies, which cannot be counted by present-day electronic circuits. The frequency comb thus compensates for the inability of existing electronics to directly count at optical frequencies. A conceptually-helpful mechanical analogue for the frequency comb technique is gear reduction, which is accomplished using meshed gears that have different radii and so rotate at different speeds but still remain locked in synchrony.

In one embodiment, the tool 18 is configured in a sonde configuration. In this configuration, the tool 18 may include a section referred to as a "sonde", which includes the sensor 20 and any other measurement sensors. The tool 18 may also include a cartridge that includes the electronics unit 20 and/or any other suitable electronics, as well as any necessary telemetry devices, power devices, and other components. Both the sonde and the cartridge may be included in a housing, such as the housing 26.

The tool 18 may be operably connected to a surface processing unit 28, which may act to control the sensor 20 and/or the downhole clock 22, and may also collect and process data generated by the sensor 20 during a logging process.

The surface processing unit 28 may include a surface clock 30, which may be synchronized to the downhole clock 22 prior to lowering the tool 18 and/or commencing the logging process. In one embodiment, the surface clock 30 is an optical clock.

The surface processing unit 28 may also include components as necessary to provide for processing of data from the tool 18. Exemplary components include, without limitation, at least one processor, storage, memory, input devices, output devices and the like. As these components are known to those skilled in the art, these are not depicted in any detail herein.

The tool 18 may be equipped with transmission equipment to communicate ultimately to the processing unit 28. Connections between the tool 18 and the surface processing unit 28 may take any desired form, and different transmission media and methods may be used. Examples of connections may include wired, fiber optic, wireless connections or mud pulse telemetry.

Figure 2:
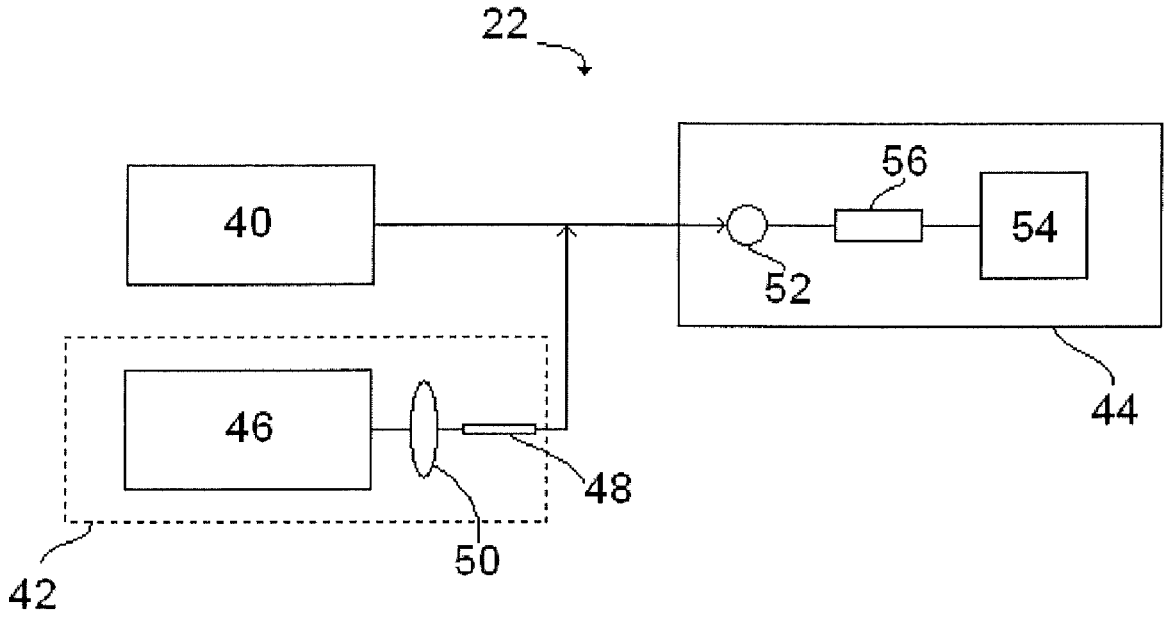
FIG. 2 depicts an exemplary embodiment of a clock used in conjunction with the systems and methods described herein.

Referring to FIG. 2, the downhole clock 22 is shown schematically to provide a frame of reference for the description following herein.

The downhole clock 22 includes an optical clock 40, a frequency comb 42, and processing circuitry 44.

The frequency comb 42 includes a light source, such as a mode-locked femtosecond laser 46 having a selected frequency and a pulse duration in the femtosecond range. An example of the femtosecond laser 46 is a titanium sapphire laser. The femtosecond laser 46 output may be coupled to an optical fiber 48 via a lens 50. In one embodiment, the optical fiber 48 is a photonic fiber having a plurality of holes along its core. In another embodiment, the optical fiber 48 is a tapered fiber.

In use, the light output from the optical clock 40 may be added to the beam produced by the frequency comb 42, which is then fed to one or more detectors 52, which are in turn connected to suitable circuitry 54 and/or any other components to convert the optical clock ticks to microwave frequency ticks which can be counted. For example, the detector 52 may output beat patterns that are measured by a counter 56.

The circuitry 54 may include any suitable components for measuring and outputting the frequency of the optical clock 40, such as various gratings, detectors, counters and other components.

In one embodiment, the downhole clock 22 may be connected to one or more power sources, such as a battery, or power sources at the surface via a wireline connection.

Although the present embodiment provides the circuitry 54 to receive and process the frequency data, any number or types of processors, circuits or devices for controlling operation of the downhole clock 22 and/or processing of data may be provided. Such devices may include any suitable components, such as storage, memory, input devices, output devices and others.

The use of optical clocks allows the clocks to remain synchronized for extended periods of time relative to prior art clocks. For example, an atomic clock such as a rubidium clock is sufficiently stable enough to be used in this manner and stay synchronized to a surface clock for several days, allowing for data collection over this time period. An optical clock, in contrast, may allow weeks or years of synchronized data collection.

Figure 3:
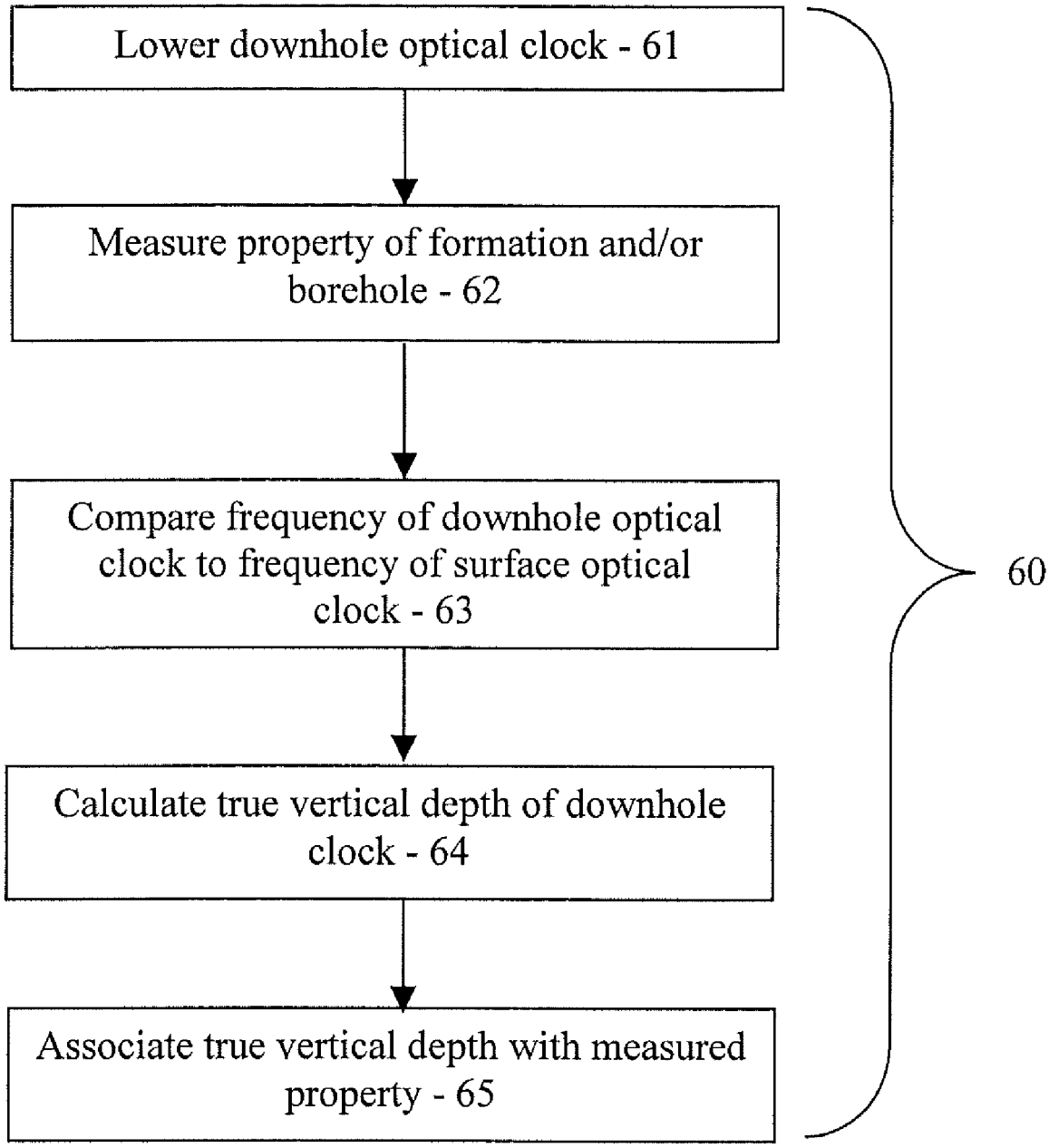
FIG. 3 is a flow chart providing an exemplary method for measuring a true vertical depth.

FIG. 3 illustrates a method 60 for calculating a true vertical depth of a downhole FE tool. The method takes advantage of the fact that, when two clocks are located at different gravitational potentials, the clock located downhill (e.g., downhole at gravitational potential, $U_1$) will run slower (i.e., experience gravitational red shift) compared to the clock located uphill (e.g., at the surface at gravitational potential, $U_2$). That is, the "clock rates", or frequencies, $f_1$, and, $f_2$, of the clocks, at respective gravitational potentials $U_1$ and $U_2$ differ fractionally by the following equation, where $\Delta f = f_2 - f_1$.

$$\Delta f/f_1 = (U_2 - U_1)/c^2,$$

where "c" is the speed of light, and "Δf" is the change in frequency. Thus, the method 60 includes calculating the true vertical depth by comparing "ticks" from a downhole optical clock to "ticks" from an uphole clock, and computing the red shift.

The method 60 includes one or more stages 61-65. The method 60 is described herein in conjunction with the downhole clock 22 and the surface clock 30, which are both optical clocks, although the method 60 may be performed in conjunction with any number and configuration of clocks, processors, receivers or other measurement tools. In one embodiment, the method 60 includes the execution of all of stages 61-65 in the order described. However, certain stages may be omitted, stages may be added, or the order of the stages changed. Furthermore, the method 60 may be performed in conjunction with wireline measurement processes, LWD or MWD processes, and any other suitable seismic measurement or other logging processes.

In the first stage 61, the tool 18 is lowered into a location in a downhole portion of the borehole 12. The tool may be lowered during and/or after the borehole 12 is drilled. In one embodiment, the tool 18, including the downhole clock 22, may be dropped down the borehole 12 in a sonde. In another embodiment, the tool 18 and/or the downhole clock 22 may be lowered down the borehole 12 by a wireline.

In the second stage 62, measurement of a property of the formation 14 and/or the borehole 12 may be performed, by receiving data from the sensor 22. In one embodiment, at well bottom, the tool 18 may record acoustic pulses emanating from the surface, which may be time stamped using the downhole clock 22, and later read when the tool 18 is retrieved. In another embodiment, such as in a LWD or MWD applications, acoustic data is recorded by the tool 18 operating remotely in the drill string. Alternatively, the tool 18 may be in communication with, e.g., the surface processor, and transmit the recorded pulse data.

In the third stage 63, the frequency of the downhole clock 22 is measured and recorded. The frequency of the downhole clock 22 is measured at the depth at which the data is received from the sensor 22.

In the fourth stage 64, the true vertical depth at which the tool 18 is positioned is calculated. As discussed above, the clock rates, i.e., frequencies, at gravitational potentials $U_1$ and $U_2$ differ fractionally by $(U_2 - U_1)/c^2$, where c is the speed of light. The true vertical depth of the tool 18 may thus be calculated based on a difference in clock rates between the surface clock 30 and the downhole clock 22. The true vertical depth may be calculated, as the difference in clock rates that is associated with a gravitational red shift (slowing) of the downhole clock 22 compared to the surface clock 30. In this example, the surface clock 30 is located at a surface height, $h_2$, and the tool 15 is located at a downhole height, $h_1$. Although in this embodiment, the surface clock 30 is located at a surface, the surface clock 30 may be located at any known or measurable depth, and thus, $h_2$ may be any depth.

In one embodiment, the change in frequency, Δf, is calculated from the difference between the frequency, $f_2$, of the surface clock 30 and the frequency, $f_1$, of the downhole clock 22. The change in frequency as a function of depth, due to changes in gravitational potential, is also calculated, which is then used to calculate the true vertical depth of the downhole clock 22. Various relationships described below may be used to calculate changes in frequency as a function of depth.

The change in frequency may be based on changes in gravitational potential as a function of depth. For example, the fractional change in frequency, $\Delta f/f_1$, for a pair of clocks located at gravitational potentials $U_1$ and $U_2$ can be expressed in terms of $f_1$ or $f_2$ and Δf as shown in the following equation, where $\Delta f = f_2 - f_1$.

$$\Delta f/f_1 = \Delta f/(f_{2-\Delta f}) = (U_2 - U_1)/c^2,$$

where $f_2$ is the frequency of the clocks 22 and 30 at the same height, i.e., height, $h_2$, Δf is the difference between the frequencies when the tool 18 is at a given height, $U_2$ is the gravitational potential at height, $h_2$, $U_1$ is the gravitational potential at height, $h_1$, and c is the speed of light.

The change in potential ΔU per $c^2$ can be computed as the integral from a true vertical depth of $h_1$ to $h_2$ of the function $\int [g(h)/c^2]*dh$, where "h" is depth and "g" is the acceleration due to gravity.

In one embodiment, the depths to which boreholes are drilled produce only a very slight change in g, so that g is assumed to be constant. Thus, the integral above for calculating the change in potential per $c^2$ may be reduced to the following equation:

$$\Delta U/c^2 = g(h_2 - h_1)/c^2$$

In another embodiment, for better accuracy, the slight variation of g from $h_1$ to $h_2$, i.e., Δg, may be taken into account, and the slight variation of g(h) may be included with h, i.e., Δg may replace g. Relative to its value at the surface, the decline in gravitational acceleration Δg at some true vertical depth, h, is calculated by the following equation.

$$\Delta g = 4\pi G\rho h,$$

where "ρ" is the average density over a selected interval, "G" is the universal gravitational constant, and "π" is the mathematical constant approximately equal to 3.14159.

In one example, as a first approximation, one can assume an average density of 2.67 g/cc for upper crustal rocks of the earth in which wells are generally drilled.

Using the above equations, and based on the measured frequencies $f_1$ and $f_2$, the fractional change in gravitational potential and corresponding change in height (i.e., $h_2 - h_1$) is calculated. Thus, the true vertical depth of the tool 18 and the downhole clock 22 is calculated relative to the surface clock 30.

In one embodiment, using the above calculations and assuming that the fractional change in g with depth is small enough to ignore (e.g., g gets weaker by about 316 parts per million with every meter of increased depth), a clock's frequency may be considered to decline linearly with its depth at the rate of about 1.09 parts per $10^{16}$, per meter of depth. Accordingly, this relationship between frequency and true vertical depth may be used to calculate the true vertical depth of the downhole clock 22 at any depth relative to the surface clock 30.

In the fifth stage 65, the true vertical depth of the downhole clock 22 may be associated with the measured properties. The true vertical depth and property data may be stored in a memory associated with the clock 22 and/or the tool 18, and may also be transmitted to another location such as the surface processing unit 28 for further processing and/or storage.

The systems and methods described herein provide various advantages over existing processing methods and devices, in that they provide for superior time measurement, and accordingly depth measurement, than prior art devices. For example, optical clocks described herein are greatly superior in precision than clocks used in prior art logging methods. Furthermore, such greater accuracy allows for the clocks to be disposed downhole for longer periods than prior art devices, e.g., weeks rather than days, to allow for longer periods of seismic data collection.

Furthermore, the super high accuracy of an "optical" clock makes it possible to perform other downhole applications for which atomic clocks such as the standard Rubidium 87 atomic clock simply would not work, such as calculating true vertical depth.

The past few decades have seen enormous improvements in clock technology. For example, the typical quartz wrist watch has a quartz crystal that oscillates at 32,768 Hz and only gains or loses 1 second per day (a short term accuracy of about $1.15\times10^{-5}$). The traditional Rubidium 87 atomic clock operates at a frequency of 6.834 GHz line and has a short term frequency accuracy of about $3\times10^{-12}$ so it would only gain or lose a second in about 10 thousand years. The latest NIST optical clock, which is based on the Mercury 199 ion, has a frequency accuracy of about $8\times10^{-17}$, so it would only gain or lose a second in about 400 million years, which is almost 40 thousand times better than the Rubidium 87 clock. Furthermore, optical clocks are contemplated that have even higher frequency accuracies on the order of, for example, $10^{-16}$ and $10^{-18}$. Thus, with optical clocks having resolutions of 1 part in $10^{16}$ or better, true vertical depth may be calculated to precisions of a meter or better, such as a centimeter for $10^{-18}$ resolution.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for measuring a true vertical depth of a downhole tool, the system comprising:

a first optical clock located at a first depth and having a first frequency;

a second optical clock disposable at a downhole location and having a second frequency at the downhole location; and a processor for receiving the first frequency and the second frequency, and calculating a true vertical depth of the second optical clock based on a difference between the first frequency and the second frequency.

2. The system of claim 1, wherein the second optical clock is synchronized with the first optical clock when the second optical clock is located at the first depth.

3. The system of claim 1, wherein the first depth is a surface depth.

4. The system of claim 1, wherein the second optical clock is disposed in the downhole tool.

5. The system of claim 1, wherein the first optical clock and the second optical clock each include an optical clock based on a Mercury 199 ion.

6. The system of claim 1, wherein the first optical clock and the second optical clock each include a frequency comb.

7. The system of claim 6, wherein the frequency comb includes a mode-locked femtosecond laser.

8. A method of measuring a true vertical depth of a downhole tool, the method comprising:

positioning a first optical clock at a first depth;

positioning the tool and a second optical clock at a downhole location;

measuring a first frequency of the first optical clock and a second frequency of the second optical clock; and calculating by a processor, a true vertical depth of the second optical lock based on a difference between the first frequency and second frequency.

9. The method of claim 8, further comprising synchronizing the first optical clock and the second optical clock when both the first optical clock and the second optical clock are at the first depth.

10. The method of claim 8, wherein the first optical clock and the second optical clock are synchronized to optical-frequency atomic electron transitions.

11. The method of claim 8, wherein the first depth is a surface depth.

12. The method of claim 8, wherein calculating the true vertical depth comprises calculating a frequency change $\Delta f$ as a function of a change in depth.

13. The method of claim 12, wherein the frequency change $\Delta f$ is calculated based on a change in gravitational potential due to the change in depth.

14. The method of claim 13, wherein the frequency change $\Delta f$ is calculated by:

calculating a fractional change in gravitational potential using the equation:

$$\Delta U/U_2 = g(h_2 - h_1)/c^2,$$

wherein $\Delta U$ is a change in gravitational potential between the first depth and the second depth, $U_2$ is a gravitational potential at the first depth, and c is the speed of light; and calculating a fractional change in frequency using the equation:

$$\Delta f/f_{h2} = (U_2 - U_l)/c^2,$$

wherein $f_{h2}$ is the second frequency, and $U_1$ is a gravitational potential at the second depth.

15. The method of claim 8, further comprising measuring at least one property of at least one of a formation and a borehole.

16. The method of claim 15, further comprising associating the true vertical depth with the at least one property.

17. A non-transitory program product comprising a machine readable instructions stored on a machine readable media, the instructions for implementing a method of measuring a true vertical depth of a downhole tool comprising:

positioning a first optical clock at a first depth; positioning the tool and a second optical clock at a downhole location;

measuring a first frequency of the first optical clock and a second frequency of the second optical clock; and calculating a true vertical depth of the second optical lock based on a difference between the first frequency and second frequency.

18. The computer program product of claim 17, further comprising synchronizing the first optical clock and the second optical clock when both the first optical clock and the second optical clock are at the first depth.

19. The computer program product of claim 17, wherein the first optical clock and the second optical clock are synchronized to optical-frequency atomic electron transitions.

20. The computer program product of claim 17, further comprising measuring at least one property of at least one of a formation and a borehole, and associating the true vertical depth with the at least one property.

* * * * *